US011322820B2

(12) United States Patent
Yang

(10) Patent No.: US 11,322,820 B2
(45) Date of Patent: May 3, 2022

(54) OUTDOOR ANTENNA

(71) Applicant: Ruixiong Yang, Guangzhou (CN)

(72) Inventor: Ruixiong Yang, Guangzhou (CN)

( * ) Notice: Subject to any disclaimer, the term of this patent is extended or adjusted under 35 U.S.C. 154(b) by 48 days.

(21) Appl. No.: 16/709,281

(22) Filed: Dec. 10, 2019

(65) Prior Publication Data

US 2020/0194866 A1 Jun. 18, 2020

(30) Foreign Application Priority Data

Dec. 11, 2018 (CN) ..... 201822067063.5
Jan. 7, 2019 (CN) ..... 201910011473.4

(51) Int. Cl.

| | |
|---|---|
| ***H01Q 1/08*** | (2006.01) |
| ***H01Q 19/30*** | (2006.01) |
| ***H01Q 19/10*** | (2006.01) |
| ***H01Q 1/12*** | (2006.01) |
| ***H01Q 19/04*** | (2006.01) |

(52) U.S. Cl.
CPC ..... *H01Q 1/08* (2013.01); *H01Q 1/1235* (2013.01); *H01Q 19/04* (2013.01); *H01Q 19/106* (2013.01); *H01Q 19/30* (2013.01)

(58) Field of Classification Search
CPC ..... H01Q 1/08; H01Q 1/088; H01Q 1/1235; H01Q 19/30; H01Q 19/04; H01Q 1/103
See application file for complete search history.

(56) References Cited

U.S. PATENT DOCUMENTS

| | | | | |
|---|---|---|---|---|
| 5,760,751 A * | 6/1998 | Gipson | ..... | H01Q 1/12 343/880 |
| 2012/0151852 A1* | 6/2012 | Thoren | ..... | H01Q 1/10 52/111 |
| 2012/0200471 A1* | 8/2012 | Yang | ..... | H01Q 19/04 343/833 |
| 2016/0156107 A1* | 6/2016 | Lee | ..... | H01Q 1/088 343/840 |

* cited by examiner

*Primary Examiner* — Andrea Lindgren Baltzell
*Assistant Examiner* — Yonchan J Kim
(74) *Attorney, Agent, or Firm* — Polsinelli PC

(57) ABSTRACT

The present disclosure relates to the field of television receiving antennas, and discloses an outdoor antenna, comprising a main body and a pair of reflective nets, wherein the reflective net comprises an assembly body, the main body comprises a fixing base, the assembly body and the fixing base are plugged into each other, and the assembly body and the fixing base are connected by a snap-connection, which allows the assembly body and the fixing base to be tightly combined with each other after being plugged in. The reflective nets can be detached from the main body, so that the entire outdoor antenna can be disassembled, which avoids packaging of the entire outdoor antenna and reduces the packaging volume. Furthermore, through the snap-connection, the assembly body and the fixing seat will not be loosened after being plugged in, and can be tightly combined with each other.

6 Claims, 6 Drawing Sheets

OUTDOOR ANTENNA

CROSS-REFERENCE TO RELATED APPLICATION

This application claims the benefits of Chinese Patent Application No. 201910011473.4, filed on Jan. 7, 2019, and Chinese Patent Application No. 201822067063.5, filed on Dec. 11, 2018, the entire contents of which both are incorporated herein in its entirety.

TECHNICAL FIELD

The present disclosure relates to the field of television receiving antennas, and particularly to an outdoor antenna for television receiving.

BACKGROUND

Yagi antenna is the most common outdoor antenna. This type of outdoor antenna has a large volume and many components. Generally, in order to protect the antenna product during transportation, it is necessary to customize a packaging box that matches the structure of the antenna product, when packing the antenna product. Since the overall structure of the antenna is relatively complicated, packaging the entire antenna product as a whole may result in an excessive packaging volume and increase packaging costs. Therefore, the existing outdoor antennas often adopt a detachable structure, such as a screw connection structure. However, the components of the outdoor antenna are detached for packaging and transportation, and then are mounted one by one with screws when in use, which may cause a tedious mounting.

SUMMARY

The present disclosure is intended to provide an outdoor antenna, which is capable of reducing the packaging volume and is convenient to mount.

In accordance with an aspect of the present disclosure, the outdoor antenna includes a main body and a pair of reflective nets, each of the reflective nets includes an assembly body, the main body includes a fixing base, the assembly body and the fixing base are plugged into each other, and the assembly body and the fixing base are connected by a snap-connection, which allows the assembly body and the fixing base to be tightly combined with each other after being plugged in.

The assembly body of a pair of reflective nets of the outdoor antenna and the fixing base of the main body are plugged into each other. The reflective nets can be detached from the main body, so that the entire outdoor antenna can be disassembled, which avoids packaging of the entire outdoor antenna and reduces the packaging volume. Furthermore, the snap-connection has the advantages of simple structure and easy mounting. Through the snap-connection, the assembly body and the fixing base will not be loosened after being plugged in, and can be tightly combined with each other, which realizes simple and convenient mounting.

Further, the assembly body and the fixing base are connected by the snap-connection, which allows the assembly body to be tightly coupled with the fixing base after being plugged in.

Specifically, the assembly is provided with a buckle, and the fixing base is provided with a buckle slot, and the buckle and the buckle slot are fastened with each other, so that the assembly body and the fixing base are tightly combined with each other after being plugged in.

Further, one end of the assembly body extends outward to form a plug, and the other end of the assembly body is provided with a socket corresponding to the plug. The plug of one of the pair of reflection nets and the socket of the other of the pair of reflective nets are plugged into each other, so that the assembly bodies of the pair of reflective net are assembled with each other, which realizes that the assembly bodies of a pair of reflective nets are connected with the fixing base after be assembled to one body, thereby achieving the purpose of further convenient mounting.

Further, the assembly body is provided with a spring arm, an extension direction of the spring arm is opposite to a plugging direction of the assembly body towards the fixing base, the buckle is disposed on the spring arm, the spring arm is provided with a pressing position that can drive the buckle out of the buckle slot. Therefore, as long as the pressing position is pressed, the buckle can be driven to loose, so that the assembly body can be quickly detached from the fixing base.

Further, after the assembly body is snap-connected to the fixing base, the pressing position is located on a periphery of the fixing base, which facilitates pressing the pressing position.

Further, the fixing base is formed with a reinforcing rib, an extension direction of the reinforcing rib is consistent with the plugging direction of the fixing base towards the assembly body, and the assembly body is formed with an engaging slot corresponding to the reinforcing rib. Adding the reinforcing rib to the fixing base can reinforce strength of the fixing base. In addition, after the fixing base is buckle-connected with the assembly body, the reinforcing rib can be matched and assembled with the engaging slot to enhance connection strength between the fixing base and the assembly body.

Further, the outdoor antenna further includes a pair of vibrators, the vibrators are movably connected to the main body, the vibrators can be expanded or folded relative to the main body, and a positioning member is disposed on the main body to fix the expanded vibrators. When packaging, the vibrators are folded toward the main body, which can further reduce the packaging volume of the antenna product. When mounting and using, the vibrators are expanded away from the main body, the vibrators in an expanded state is fixed by the positioning member, and the vibrators are movably connected to the main body, so that the steps of detachment and assembly can be reduced, the mounting process of the antenna product is further simplified, and the mounting is more convenient.

Further, the vibrators are movably connected to the main body. Specifically, the vibrators are hinged with the positioning member on the main body by bolts. The vibrators may be U-shaped, in-line shaped or arc-shaped.

Further, the positioning member is provided with a catch slot, and the size of the catch slot matches the size of the vibrators; when the vibrators are rotated to slide into the catch slot from a side wall of the catch slot, the vibrators are stuck in the catch slot, and the vibrators are fixed in the expanded state; when the vibrators are rotated to slide out of the catch slot from the side wall, the vibrators are folded.

Further, in order to enhance the ability of the positioning member to position the unfold vibrators, the positioning member is further provided with a stopper that prevents the vibrators from sliding out of the catch slot from the other side wall of the card slot along an expanding direction.

The beneficial effects of embodiments according to the present disclosure are:

The outdoor antenna of the present disclosure adopts a variable volume design. The assembly bodies of a pair of reflective nets of the outdoor antenna and the fixing base of the main body are plugged into each other. The reflective nets can be detached from the main body. Therefore, the entire outdoor antenna can be disassembled, which avoids packaging of the entire outdoor antenna and reduces the packaging volume. Furthermore, the mounting with the snap-connection is simple and fast. Through the snap-connection, the assembly body and the fixing base will not be loosened after being plugged in, and can be tightly combined with each other. The outdoor antenna has the beneficial effects of small packaging volume and convenient mounting.

DETAILED DESCRIPTION OF EMBODIMENTS

The technical solution of the present disclosure will be further described in detail in combination with exemplary embodiments below.

Figure 1:
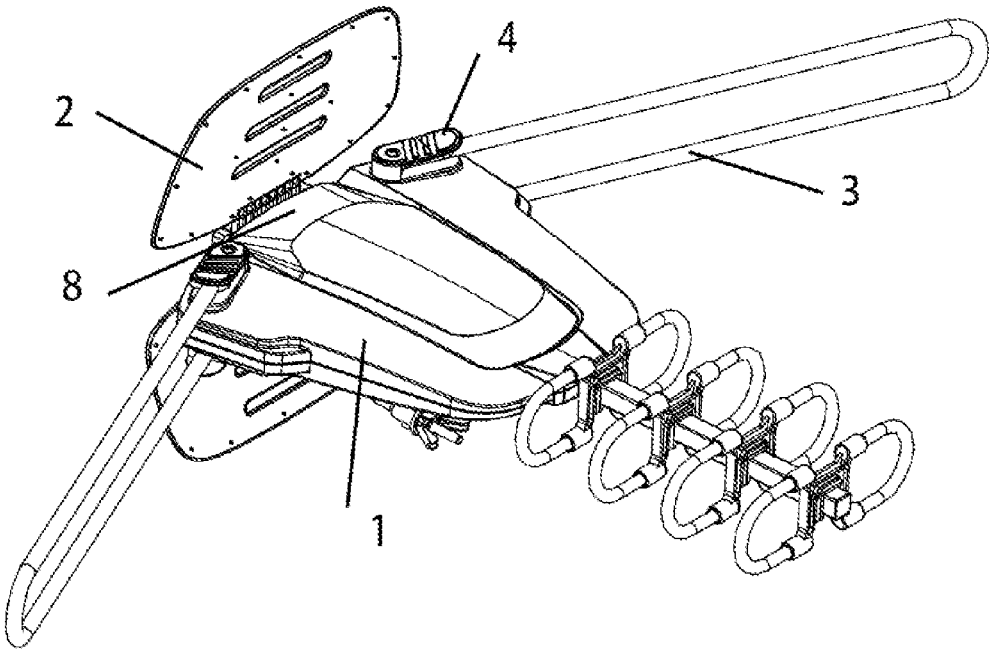
FIG. 1 is a structural diagram illustrating an outdoor antenna according to an embodiment of the present disclosure.

As shown in FIG. 1, an outdoor antenna includes a main body 1, a pair of reflective nets 2, and a pair of vibrators 3. In order to facilitate the description of the present disclosure and simplify the description, based on the orientation shown in FIG. 1, the pair of reflective nets 2 are located on an upper side and a lower side of the main body 1 respectively, a pair of vibrators 3 are located on a left side and a right side of the main body 1 respectively, and a positioning member 4 is fixed on each of the upper and lower opposite surfaces of the left and right sides of the main body 1. The vibrator 3 is U-shaped. Both ends of the vibrator 3 are hinged to the positioning member 4 by bolts. The vibrator 3 is capable of being expanded or folded relative to the main body 1, and the expanded vibrator 3 is fixed by the positioning member 4.

Figure 2:
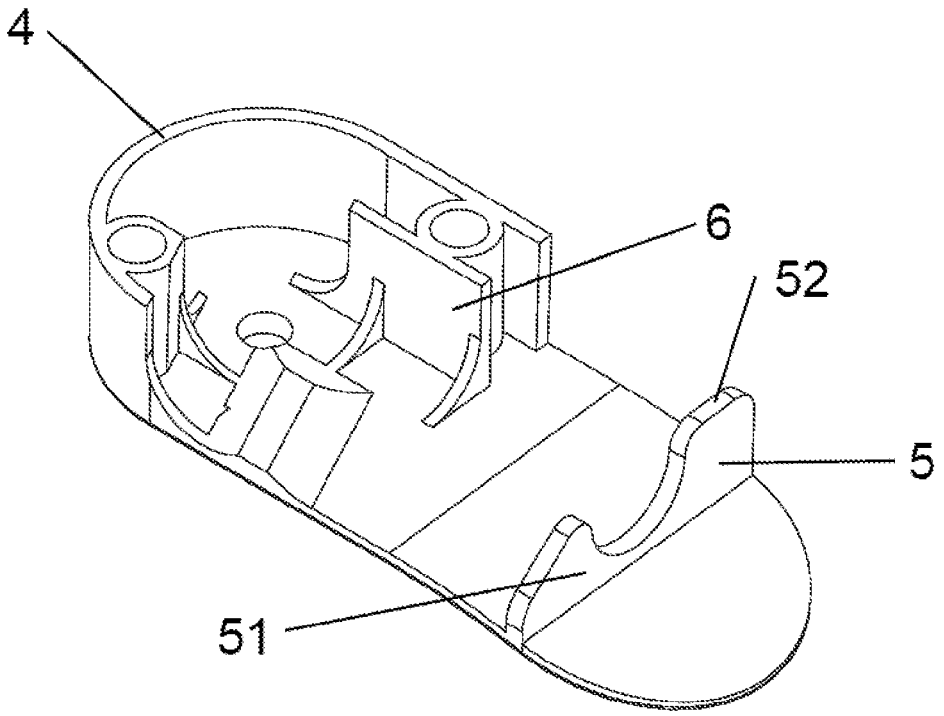
FIG. 2 is a structural diagram illustrating a positioning member of an outdoor antenna according to an embodiment of the present disclosure.
Figure 3:
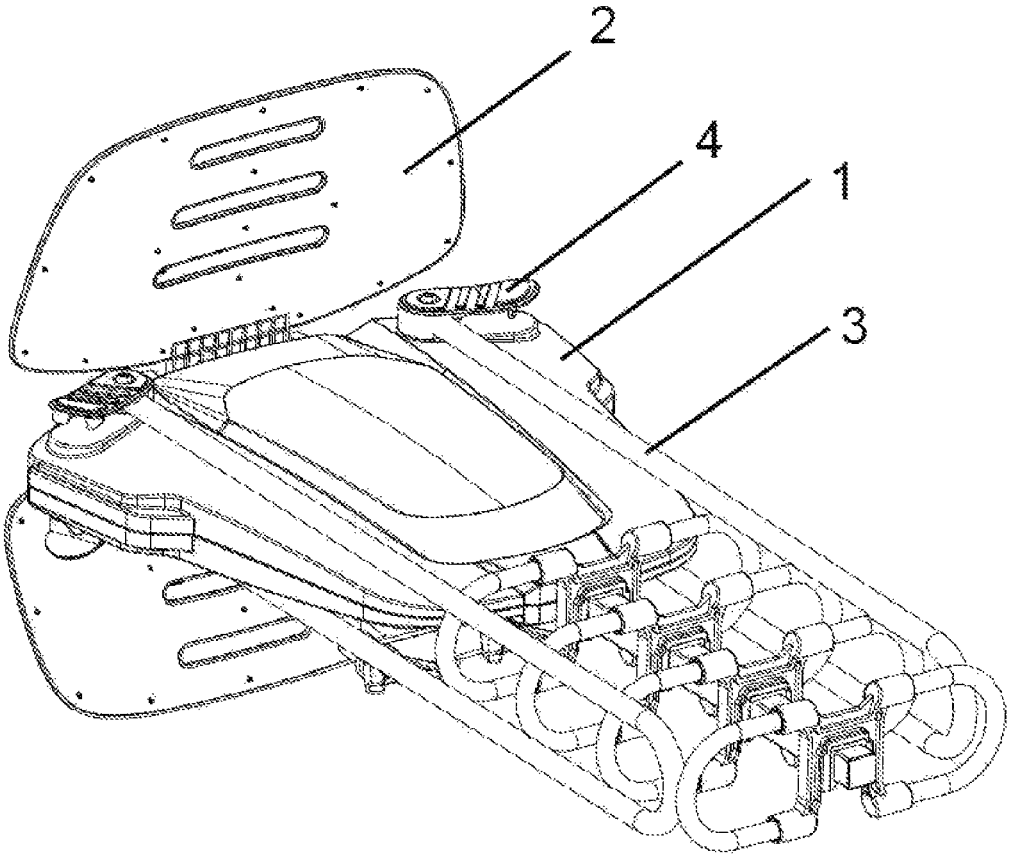
FIG. 3 is a schematic diagram illustrating a folded state of an outdoor antenna according to an embodiment of the present disclosure.

As shown in FIG. 2, the positioning member 4 is provided with a catch slot 5, and the catch slot 5 matches the vibrator 3 in size. Since a connection relationship between the vibrator 3 and the positioning member 4 is a hinge joint, the vibrator 3 can rotate relative to the main body 1, thereby achieving expanding or folding. When the vibrator 3 is expanded relative to the main body 1, the vibrator 3 is rotated to slide into the catch slot 5 via a side wall 51 of the catch slot 5, and the vibrator 3 is stuck in the catch slot 5, so that the vibrator 3 is fixed in an expanded state. The positioning member 4 is further provided with a stopper 6 that can prevent the vibrator 3 from sliding out of the catch slot 5 via the other side wall 52 of the catch slot 5 along the expanding direction. The vibrator 3 is folded relative to the main body 1 when it is rotated to slide out of the catch slot 5 via the side wall 51. The expanded state of the vibrator 3 is shown in combination with FIG. 1, and a folded state of the vibrator 3 is shown in combination with FIG. 3.

In order to save packaging space, the reflective net 2 can be detached from the main body 1, so that the entire outdoor antenna is disassembled. In such way, packaging of the entire outdoor antenna is avoided and the packaging volume is thus reduced. The reflective net 2 is easy to mount on the main body 1, which will be described below.

Figure 4:
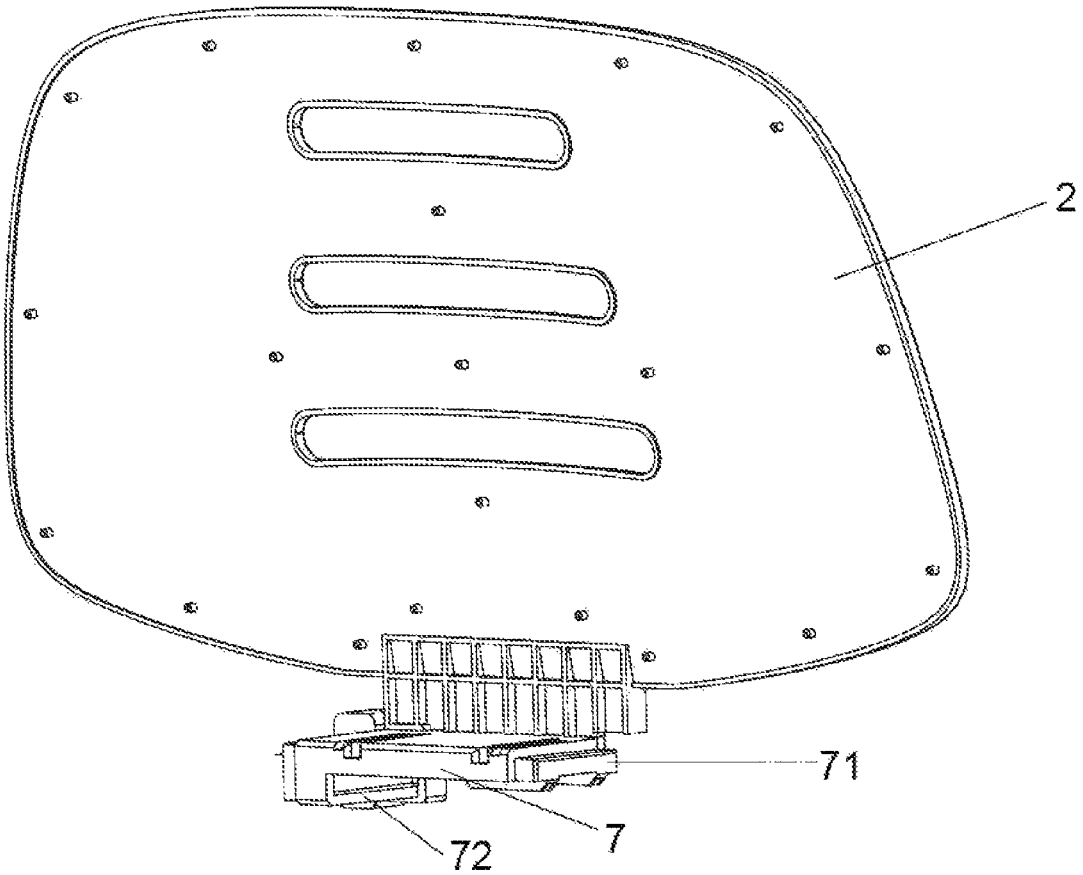
FIG. 4 is a structural diagram illustrating a reflective net of an outdoor antenna according to an embodiment of the present disclosure.
Figure 5:
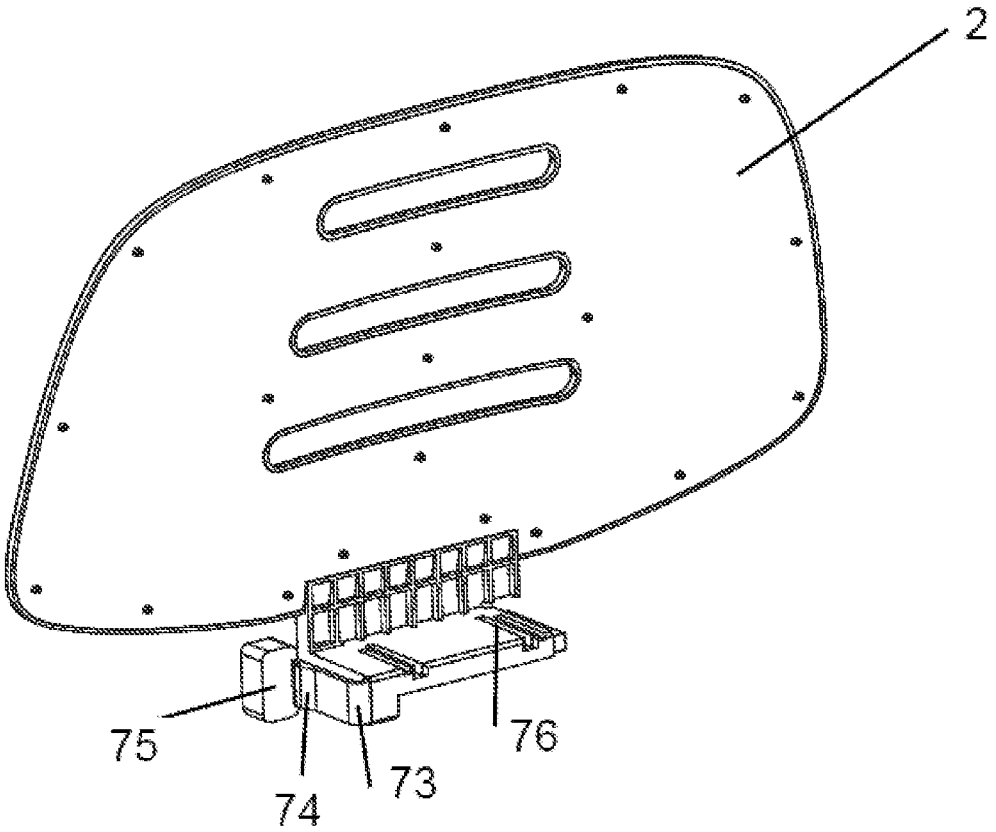
FIG. 5 is other structural diagram illustrating a reflective net of an outdoor antenna according to an embodiment of the present disclosure.
Figure 6:
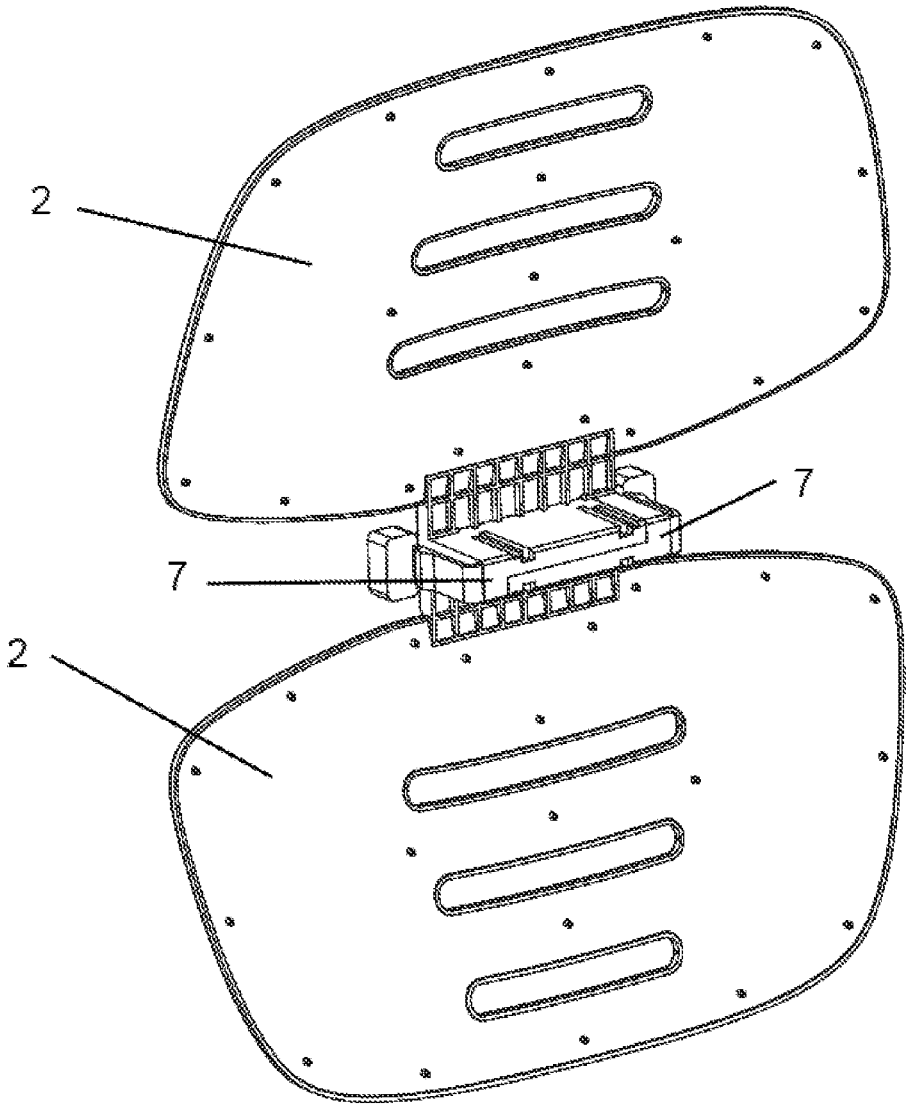
FIG. 6 is a schematic diagram illustrating that a pair of reflective nets of an outdoor antenna are in an assembled state according to an embodiment of the present disclosure.

Referring to FIG. 4, the reflective net 2 includes an assembly body 7. One end of the assembly body 7 extends outward to form a plug 71, and the other end of the assembly body 7 is provided with a socket 72 matching a corresponding plug 71. Referring to FIG. 6, a plug 71 of a reflective net 2 and a socket 72 of the other reflective net 2 are plugged into each other, so that a pair of reflective nets 2 are assembled together to form one body by respective assembly body 7. Referring to FIG. 4 and FIG. 5 are structural diagrams illustrating the reflective net 2 at different angles. An outer side of the assembly body 7 is provided with a spring arm 73, and an extension direction of the spring arm 73 is opposite to a plugging direction of the assembly body 7 towards the fixing base 8 (shown in FIG. 1). The spring arm 73 is provided with a buckle 74, and the fixing base 8 is provided with a buckle slot (not shown in figures). Referring again to FIG. 1, the main body 1 is provided with the fixing base 8, the assembly body 7 and the fixing base 8 are plugged into each other, the assembly body 7 and the fixing base 8 are connected by a snap-connection, which allows the assembly body 7 and the fixing base 8 to be tightly combined with each other after being plugged in. In the present embodiment, the snap-connection is achieved by fastening the buckle 74 and the buckle slot with each other. In order to facilitate detaching, the spring arm 73 is provided with a pressing position 75. The pressing position 75 is designed as a convex member in the present embodiment. With reference to FIG. 6, after the assembly body 7 is snap-connected with the fixing base 8, the pressing position 75 is located on a periphery of the fixing base 8. The pressing position 75 can drive the buckle 74 out of the buckle slot. Therefore, when mounting the antenna, firstly, the pair of reflective nets 2 are assembled together by respective assembly bodies 7, and then the pair of assembly bodies 7 that have been assembled into one body and the fixing base 8 are plugged into each other. The buckle 74 and the buckle slot are fastened to each other to complete the snap-connection. Therefore, the assembly body 7 and the fixing base 8 are tightly combined with each other after being plugged in. If the antenna needs to be disassembled, pressing the pressing position 75 located on the periphery of the fixing base 8 can drive the buckle 74 out of the buckle slot, and a pair of assembly bodies 7 can be detached from the fixing base 8. The entire mounting and disassembling process is simple and fast.

The fixing base 8 is formed with a reinforcing rib (not shown in figures), and an extension direction of the reinforcing rib is consistent with the plugging direction of the fixing base 8 towards the assembly body 7. The assembly body 7 is formed with an engaging slot 76 that matches a corresponding reinforcing rib. After the fixing base 8 and the assembly body 7 are fastened with each other, the reinforcing rib can be matched and assembled with the engaging slot 76, which can enhance connection strength of the fixing base 8 and the assembly body 7.

The outdoor antenna provided by the embodiment of the present disclosure has been described in detail above, specific embodiments are used herein to explain the structure and mounting of the present disclosure, and the description of the above embodiments is only used to help understand the method and the core concept of the present disclosure; meanwhile, for those of ordinary skill in the art, according to the concept of the present disclosure, there will be changes in the specific implementation. In summary, the content of this description should not be construed as a limitation on the present disclosure.

What is claimed is:

1. An outdoor antenna, comprising:

a main body comprising a fixing base;

and an assembly of a pair of reflective nets positioned on opposite sides of the main body, each of the pair of reflective nets including an assembly body;

wherein the assembly body has first and second opposite ends, the first end of the assembly body is provided with a protrusion extending outward in a direction opposite to the second end of the assembly body, and the second end of the assembly body is provided with a receiver having a recess recessed in a direction opposite to the first end of the assembly body;

wherein the assembly bodies of the pair of reflective nets are shaped to engage with each other to form the assembly, and the assembly bodies of the pair of reflective nets are configured to be inserted into the fixing base to form the outdoor antenna after forming the assembly;

wherein the receiver of the assembly body of one reflective net of the pair of reflective nets is shaped to receive the protrusion of the assembly body of another reflective net of the pair of reflective nets, when the assembly bodies of the pair of reflective nets are engaged with each other;

wherein the assembly body is provided with an elastic arm at the second end, the elastic arm extends in a direction opposite to a direction along which the assembly body is inserted into the fixing base, the elastic arm is provided with a buckle adapted to be engaged with a buckle slot arranged on the fixing base, and the elastic arm is also provided with a pressing portion which can be pressed to cause the buckle to be disengaged from the buckle slot of the fixing base;

wherein the outdoor antenna further comprises a pair of U-shaped vibrators, the vibrators are movably connected to the main body and are expandable or foldable relative to the main body, and the main body is provided with a first and second pair of positioning members adapted to fix the vibrators respectively when the vibrators are in an expanded state; and wherein each positioning member is provided with a catch slot matching a corresponding one of the vibrators in size; when the corresponding one of the vibrators is rotated to slide into the catch slot via a side wall of the catch slot, the corresponding one of the vibrators is stuck in the catch slot, and the corresponding one of the vibrators is fixed in the expanded state; and when the corresponding one of the vibrators is rotated to slide out of the catch slot via the side wall, the corresponding one of the vibrators is folded.

2. The outdoor antenna of claim 1, wherein the protrusion is a plug, and the receiver is a socket matching to the plug.

3. The outdoor antenna of claim 1, wherein after the assembly body is snap-connected to the fixing base, the pressing portion is located on a periphery of the fixing base.

4. The outdoor antenna of claim 1, wherein the vibrators are hinged with the positioning member on the main body by bolts.

5. The outdoor antenna of claim 1, wherein each positioning member is further provided with a stopper which is used for preventing the vibrators from sliding out of the catch slot via another side wall of the catch slot along an expanding direction.

6. The outdoor antenna of claim 1, wherein the assembly bodies of the pair of reflective nets are shaped to be inserted into the fixing base by a snap-connection, so that the assembly bodies and the fixing base are tightly combined.

* * * * *